US007240897B2

(12) United States Patent
Wynes

(10) Patent No.: US 7,240,897 B2
(45) Date of Patent: Jul. 10, 2007

(54) MIXING APPARATUS

(76) Inventor: Anthony G. Wynes, Mill Lane, The Beckery, Glastonbury, Somerset (GB) BA6 9NT ( * ) Notice: Subject to any disclaimer, the term of this patent is extended or adjusted under 35 U.S.C. 154(b) by 38 days.

(21) Appl. No.: 10/502,914

(22) PCT Filed: Jan. 28, 2003

(86) PCT No.: PCT/GB03/00386

§ 371 (c)(1),
(2), (4) Date: Oct. 28, 2004

(87) PCT Pub. No.: WO03/064017

PCT Pub. Date: Aug. 7, 2003

(65) Prior Publication Data

US 2005/0056951 A1 Mar. 17, 2005

(30) Foreign Application Priority Data

Jan. 28, 2002 (GB) ..... 0201921.4

(51) Int. Cl.
*B01F 3/04* (2006.01)

(52) U.S. Cl. ..... 261/79.2; 261/124; 210/221.2; 210/758

(58) Field of Classification Search ..... 261/30, 261/77, 79.2, 120, 124, 126; 210/758, 220, 210/221.2, 242.2
See application file for complete search history.

(56) References Cited

U.S. PATENT DOCUMENTS 624,527 A * 5/1899 Otto ..... 261/77
1,758,983 A * 5/1930 Seymour ..... 261/79.2
1,791,949 A 2/1931 Boulade
2,630,749 A 10/1953 Ball et al.
2,669,440 A * 2/1954 Lindenbergh ..... 261/124
3,365,860 A 1/1968 Boris
3,452,966 A 7/1969 Smolski
3,628,775 A 12/1971 McConnell et al.
3,722,679 A 3/1973 Logue
3,758,083 A 9/1973 Palmer
3,761,065 A * 9/1973 Rich et al. ..... 261/76
3,814,395 A 6/1974 Kaelin
3,829,070 A 8/1974 Reba et al.
3,852,384 A * 12/1974 Bearden ..... 261/77
3,855,367 A 12/1974 Webb
3,968,086 A 7/1976 Romanowski
4,051,035 A 9/1977 Boschen et al.

(Continued)

FOREIGN PATENT DOCUMENTS

DE 22 24 698 12/1972

(Continued)

*Primary Examiner*—Scott Bushey
(74) *Attorney, Agent, or Firm*—Hudak, Shunk & Farine Co. LPA

(57) ABSTRACT

Mixing apparatus is disclosed suitable for the mixing and/or aeration of large bodies of water e.g. lakes or reservoirs. One particular use is in causing controlled destratification. Another area of use is in the aeration or oxygenation of liquid waste. The mixing apparatus has a draft tube (1) with an open interior, and gas injectors (6) to drive an upward flow of liquid through the draft tube (1). An arrangement of angled vanes (4) at the intake of the draft tube imposes swirl on the flow, which then rises unobstructed through the draft tube (1). No moving parts are involved.

23 Claims, 5 Drawing Sheets

U.S. PATENT DOCUMENTS

| | | | | | |
|---|---|---|---|---|---|
| 4,051,204 | A | | 9/1977 | Müller et al. | |
| 4,060,574 | A | | 11/1977 | Verner et al. | |
| 4,065,527 | A | * | 12/1977 | Graber | 261/79.2 |
| 4,215,081 | A | * | 7/1980 | Brooks | 261/122.1 |
| 4,244,821 | A | | 1/1981 | Molvar | |
| 4,569,757 | A | * | 2/1986 | Moore | 210/220 |
| 5,227,056 | A | * | 7/1993 | Makino | 210/170 |
| 5,376,311 | A | * | 12/1994 | DeGuzman | 261/77 |
| 5,466,369 | A | | 11/1995 | Hess et al. | |
| 6,032,931 | A | * | 3/2000 | Plunkett | 261/77 |
| 6,382,601 | B1 | | 5/2002 | Ohnari | |

FOREIGN PATENT DOCUMENTS

| | | |
|---|---|---|
| DE | 25 02 660 | 8/1975 |
| EP | 0 039 204 | 11/1981 |
| EP | 0 220 345 | 5/1987 |
| EP | 0 826 640 | 3/1998 |
| GB | 1 482 191 | 8/1977 |
| GB | 2 008 961 | 6/1979 |
| JP | 09112508 | 5/1997 |
| WO | WO 79/00895 | 11/1979 |

* cited by examiner

MIXING APPARATUS

FIELD OF THE INVENTION

This invention has to do with apparatus and methods for causing mixing in bodies of liquid using gas bubbles. A primary aspect is to do with causing mixing in large bodies of water such as ponds, lakes, reservoirs or indeed the sea, where usually the mixing of the liquid is important. Another aspect is to do with gasification in liquid treatment plants, e.g. for sewage or other waste treatment, where usually the mixing of gas is important.

BACKGROUND

There are circumstances in which it is important to be able to mix bubbles of air or other gas into a body of liquid in order to treat it. One well-known instance is waste water treatment. Industrial effluents and sewage need aeration. Less well known but of great importance is the treatment or aid to natural regeneration of large static water supplies, such as rivers, lakes and reservoirs. Particularly where there is little or no natural flow or circulation, such large bodies of water are liable to certain difficulties which can render them unfit for use unless special measures are taken. In particular, bodies of water tend to stratify stably into layers of different temperatures, which do not mix with one another and which contain different levels of dissolved oxygen. Water from lower layers generally contains very little dissolved oxygen. It may contain high levels of dissolved metals or other pollutants. It is usually not fit for use. This is a problem in a reservoir if the level falls. Another issue is the growth of algae, particularly blue-green algae, which is an undesirable presence in reservoirs and flourishes at certain levels in still water, particularly the sunlit surface layers where it consumes oxygen ("BOD"). Chemical reactions occurring at lower or bed level may also consume oxygen ("COD"). The sea is likewise prone to stratification, despite tidal flows, e.g. there can be problems for fish farms and shellfish farms when concentrations of undesirable organisms such as algae arise near or are carried into the farm zone in a stable stratum.

Over the years there have been various proposals for dealing with these problems. One approach is to generate a line source or point source of bubbles by pumping compressed air through a series of holes in a pipe lying on the bed, or through a porous block. The rising bubbles entrain water and generate a buoyant bubble plume—a mixture of water and bubbles—which causes vertical exchange and mixing, reducing the bad effects of thermal stratification. A refinement of this is to provide an upright tube near the bottom of the body of water and pump compressed air into the bottom of this tube, in the manner of an air lift pump used in dredging. The resulting imbalance of hydrostatic pressure forces the low-density air/water mixture continually up the tube, creating a substantial upward flow into which (a secondary benefit) some extra oxygen may dissolve. The air/water mixture leaving the top of the tube entrains further near-bed water as it rises towards the surface, increasing the vertical exchange effect. The best entrainment is achieved when the bubbles are small and evenly distributed in the tube and the flow is strongly turbulent and rotational (swirling). U.S. Pat. No. 3,452,966 (Smolski) describes a device known commercially as the "Helixor" in which the cylindrical tube interior is spanned by an integrally-extruded helically-twisted strip, to cause a rotational flow when compressed air is directed into the two openings at its lower end from holes in an air line. This device has been widely used over the years. However it is difficult to make, and the air bubbles tend to be large and to follow the shortest path up the helix without mixing with the water. Also the flow resistance is high. See also EP-A-826640. Other prior proposals use a draft tube with an empty interior, either without rotation or creating rotation flow by the circumferential angling of compressed air input jet openings near the base of the column. See WO 79/00895 and U.S. Pat. No. 3,855,367. However the rotational impetus in the latter is small.

In the waste treatment field, many gasification apparatus are described using rotating impellers or paddles to drive mixing between liquid and gas, but the need for a mechanical drive in situ makes these expensive and limited in their field of use.

SUMMARY OF THE INVENTION

We now propose further developments in such devices and methods.

One particular interest is in achieving a high degree of liquid movement and mixing in relation to the volume and pressure of gas injected. Another aim is to provide a simple and strong construction.

A first proposal relates to means for creating rotational flow in the draft conduit while thoroughly mixing bubbles to promote a large homogeneous swirling buoyant plume. To maximise the water discharge, it is preferable to have the main bore of the conduit substantially unobstructed (unlike U.S. Pat. No. 3,452,966), e.g. by vanes, baffles or the like. We propose to induce rotational flow in the liquid drawn in at the base of the tube by providing an angled vane arrangement, e.g. a set of one or more angled vanes. These may be distributed around a circumferential water intake at the base or intake end of the draft tube. The radial extent of these vanes may lie at least partially, and preferably substantially entirely, outside the diameter of the draft tube. A clear central region may be defined in their midst. Preferably the foot of the tube comprises or, connects to a radially-outward projection e.g. outwardly-flaring portion beneath which the vanes are disposed. The vanes are preferably substantially vertical for simplicity of construction. Preferably they are flat, again for simplicity of construction, although curved vanes may be used. Thus the rotation of the flow i.e. tangential component may be induced substantially or solely by the angling of the vanes relative to the radial direction, especially if the flow velocity at the vanes is of the same order as that up the tube. Since the vanes can be a fixed arrangement—the rotation arising from the flow impetus past them—there is no need for any moving parts. The vanes may be supported from beneath by a common base, e.g. a plate underlying the draft tube. They may be sandwiched between upper and lower plates or other members. Such a plate or base can be used alone or with other structure for mounting the apparatus in a suitable position and orientation relative to the body of liquid concerned, or relative to its floor or bed. For example a known alternative is to suspend the assembly by cable(s) from above. At least for the purpose of aerating and/or mixing in reservoirs it is normally desired to mount the device sufficiently high to prevent mud, stones or other undesirable substances e.g. polluted sediment from being sucked up, and/or to protect the ecology of the bed region. For this purpose a suitable support base has a stabilising bottom structure, e.g. legs or a wider platform or frame, with an upstanding pedestal or platform adapted for the mounting of the mixing apparatus with its draft tube(s) and vane arrangement.

The number of vanes is not critical. Usually it will be from three to ten. However it can be significantly optimised, e.g. by trial, for a given set-up. We find that a horizontal gap spacing between the vanes is preferably at least ⅓ of their chord length, if the size of the base permits.

A preferred feature is that the axial (vertical) inner wall surface of the draft tube meets an outwardly projecting or flaring wall portion which overlies the vanes at an angle less than 90°, and/or with a gradual curve. Preferably the radius of this curve is at least 50 mm and more preferably at least 100 mm, although this depends on the overall dimensions of the device. Alternatively stated the curve radius is preferably from ⅕ or ⅐ to ⅒ the adjacent draft tube diameter. Desirably the outwardly-flared wall inner surface curves around from vertical at least to horizontal.

To create a flow, a gas injector arrangement is provided for injecting gas, e.g. compressed air, preferably at least at or adjacent to the foot of the draft tube. Preferably this means comprises an area array of jets, distributed over and preferably around the base region of the tube. Preferably an array of jets is distributed circumferentially in relation to the draft tube, on the draft tube's interior wall and/or below that level, e.g. at the level of the vanes. These injector nozzles are preferably directed obliquely relative to the radial direction so as to induce or follow rotation around the tube axis, although when vanes are provided as proposed above this is not essential. A large number of relatively small jets is found to be better than a few large air pipe outlets (where the large bubbles mix poorly), and better than a "bubble block" of permeable material which makes highly dispersible microbubbles but requires a high pressure. Preferably there are at least 10, more preferably at least 20 jets. Preferably each jet is not greater than 2 mm or 3 mm across. For economy, preferably the loss of head at the jets is not more than about 0.5 bar, more preferably not more than about 0.3 bar. Alternatively or additionally, the bubble size in the use of the device is preferably not more than about 10 mm (initial size, at the intake end). Larger bubbles entrain water less effectively and reduce the buoyancy of the rising plume.

A further specific proposal herein, preferably combined in the above proposal but of independent significance and novelty, is to inject a least part of the air into the draft tube upwardly from a central injection point or region at or below the bottom of the tube. This is found to promote a high rate of flow, particularly in conjunction with the other features proposed herein.

The central injection region or point is preferably at or below an axial position where the draft tube flares outwardly.

The means for feeding pressurised gas to the jets is not critical, but can be chosen to take the simplest form depending on the arrangement of jets. Thus, where the draft tube itself has a circumferential array of jets, these may be supplied by an annular gas manifold around the tube wall. A central gas supply may lead to a central injection point as proposed above. Gas conduits may lead from this central point to supply other injection points, e.g. via radiating tubes. One preferred embodiment has a set of tubes radiating out from the central injection point, these tubes having respective sets of one or more injection holes for injecting gas. These jets may be distributed across the base area beneath the draft tube and/or up the sides of the region, e.g. up the trailing edges of the vanes.

Another aspect of the invention is a method of mixing gas bubbles with a body of liquid, especially treating or aerating a lake, pond, sea or reservoir, or a body of liquid waste such as sewage, by providing a draft tube in the liquid and passing compressed gas in any manner as described herein, to cause mixing of the gas with the liquid and a corresponding upflow of gasified liquid up the draft tube and out of its top-end. For most purposes air is a suitable gas. For waste treatment, where the gasification is chemically important, oxygen-containing gas is preferred e.g. air, oxygen or oxygen-enriched air.

An optional enhancement of the system is to form the draft tube with upper and lower stages, the top of the lower draft tube leading into the base of the upper draft tube with a liquid input opening between them. This liquid input opening may be a full-circumference opening e.g. with a set of vanes which may have any one or more of the features recited above for the first vane arrangement. Particularly preferable is that the upper draft tube has a larger diameter than the lower. This is found to give enhanced water flow rate at high air flow rates, i.e. reduce choking, compared with a single stage set-up. Furthermore the upper draft tube may have its own set or sets of gas injection jets, e.g. distributed circumferentially or in any other arrangement as proposed above.

Generally speaking, it is preferred that the draft tube in the present invention is entirely free of internal obstructions over most or all of its length. Preferably it has a uniform cross-section (preferably it is cylindrical). The preferred embodiment has the vane arrangement disposed all or entirely outside the projected diameter of the main run of draft tube, at its intake end. It would however be possible to provide the angled vane substantially or entirely within the diameter of the tube, and even inside the tube, provided that their axial extent is sufficiently limited that they do not seriously hinder flow and/or interfere with the free dispersion of gas bubbles. Preferably at least 80%, more preferably at least 90%, of the axial tube length is free of traverse by vane arrangements.

One may contemplate providing an axially-localised vane arrangement above the tube intake, for example at the tube exit. Preferably such vanes extend less than 20%, less than 10% or more preferably less than 5% of the axial length of the total draft tube (including any extension carrying the vanes). Preferably the vanes, by being short, occlude (in plan) less than half and preferably less than 25% of the plan flow area of the draft tube immediately before these vanes. It would be possible, although not preferred, to provide a mixing apparatus which has its angled vane arrangement at some location other than the intake end of the draft tube, subject to these being fixed vanes and axially localised e.g. according to the criteria proposed above.

Embodiments of our proposals are now described with references to the accompanying drawings.

DETAILED DESCRIPTION OF PREFERRED EMBODIMENTS

Figure 1:
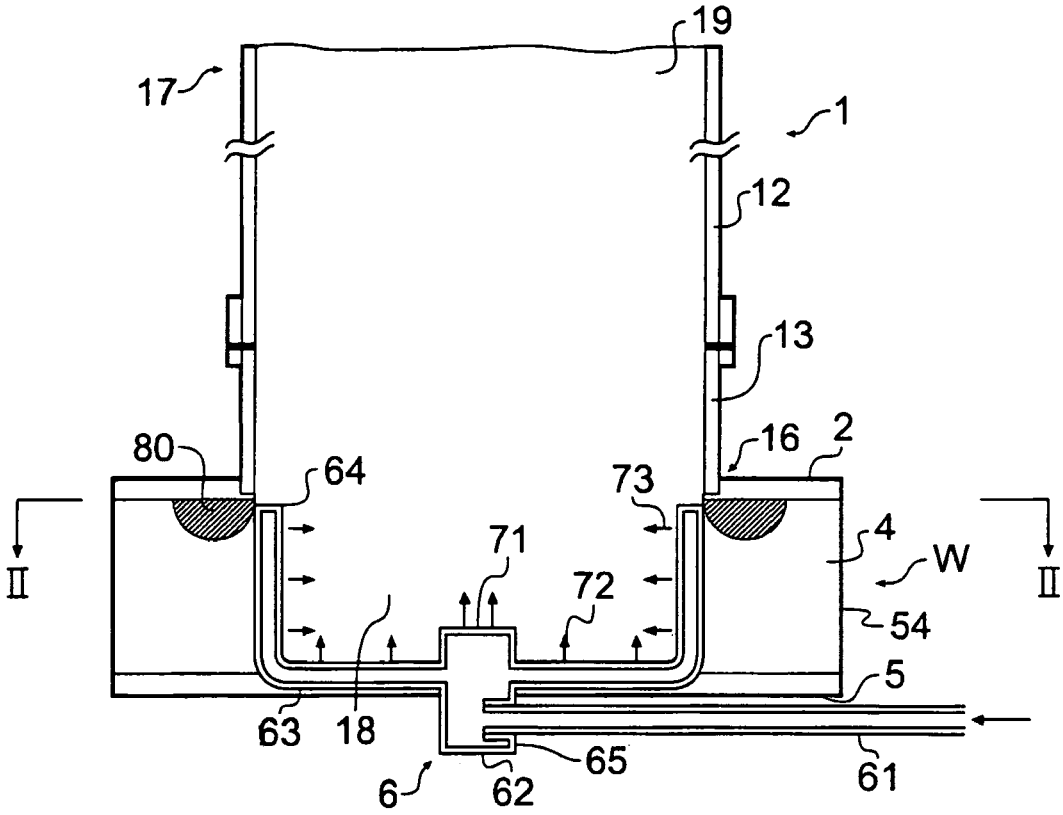
FIG. 1 is a schematic axial cross-section through a first embodiment of mixing apparatus.
Figure 2:
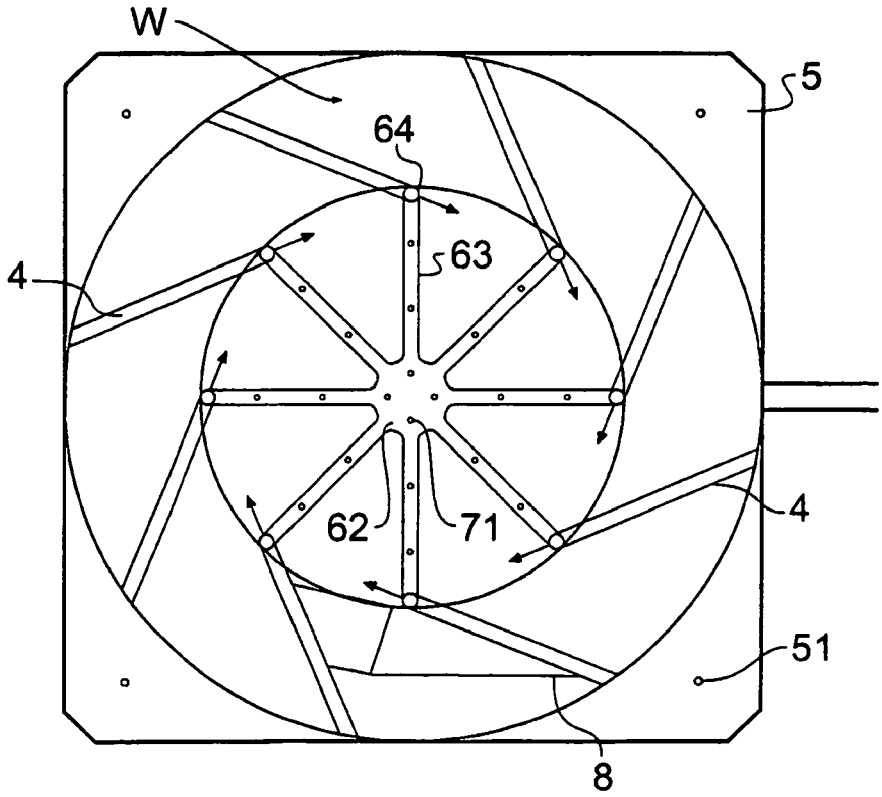
FIG. 2 is a radial section at II-II of FIG. 1.

With reference to FIGS. 1 and 2, a mixing/aerating apparatus has an upright cylindrical draft tube 1 open at its upper (exit) and lower ends 17,16. The material of the tube 1 is not critical; it may be of metal or plastics depending on circumstances. In this embodiment the internal diameter of the tube is 600 mm. The performance of the device in terms of water flow varies in a predictable manner according to the length of the draft tube and the depth of water. Typically the length is from 1 or 2 to 3 or 4 m for use in mixing liquid layers e.g. in a reservoir. For waste treatment it may be shorter, in accordance with the available depth of liquid. The bottom (intake) end 16 of the draft tube 1 is joined to a flat annular ring plate 2 which projects radially outwardly from the base of the tube. For convenience of transporting the device, in practice a short tube stump section 13 is bonded or welded into the opening of the ring plate 2 and then in a separate step screwed or bonded to the foot of the main section 12 of the draft tube 1.

The arrangement is mounted on a flat base plate 5. In use this may be fixed on a stand or frame support (see FIG. 8) to give the desired height and stability, over the bed of a body of water. The stand or frame will also usually include means for locating and fixing a compressed air supply pipe relative to the device. The base plate is of e.g. stainless steel.

A set of eight vanes 4 extends vertically between the base plate 5 and the annular ring plate 2, thereby mounting the draft tube assembly on the base plate 5. In elevation these vanes 4 are simple flat rectangular pieces, either plastic or metal in accordance with design requirements. Importantly, as seen in FIG. 2, they are all angled to the radial direction (at about 70°) so that water entering the assembly (arrow W) enters with a substantial rotational or swirling velocity component relative to the axis of the tube. It may be preferred to have these vanes curved (in plan, i.e. as would be seen in FIG. 2) to follow the flow lines more closely. Indeed, they may be curved in two planes to follow the vertical curve of the intended flow path. However this complicates construction and we find good results, as well as adequate support of the tube 1, with the straight flat vanes shown.

An air injection system 6 is provided in the central region of the base plate 5. A central manifold chamber 62 is mounted through a central hole in the base plate. Its part projecting below the base plate has a pipe fitting 65 to which an air inlet pipe 61 is connected. This pipe in turn is connected in use to a take-off from a main compressed air supply pipe running across the lake bed. Above the base plate 5, the air manifold 62 presents an upward surface with a set of central air jets 71 directed vertically. Radiating outwardly from the manifold 62 are eight subsidiary air supply tubes 63 extending horizontally across the base to meet the inner edge of a respective one of the vanes 4, and having an upward extension 64 which runs up the vane inside edge. Upwardly-directed jet openings 72 provided on the radial tube portion 63, and a obliquely inwardly-directed jet openings 73 are provided on the upward extensions 64 of these tubes. See FIG. 2 for arrows indicating the jet direction, co-rotational with the flow W through the vanes to minimise flow disruption. These air injection components are made of stainless steel in this embodiment.

It will be understood by the skilled reader that when this apparatus is positioned upright adjacent the bed of a body of water, and compressed air pumped to the air system 6 such that jets of air issue rapidly from the various jet openings 71,72,73, a swirling upflow of mixed air/water is induced in the draft tube 1 and initiates a corresponding inflow of water W through the vanes 4 at the base. The orientation of the vanes gives a rotation to the entire draft flow which is maintained up the draft tube. It is enhanced by the angled air jets 73.

It will be noted that the interior of the draft tube is entirely unobstructed, so that the air/water mixture rises freely and we find this gives excellent rate of flow relative to the rate of air supply. In destratification or other mixing applications in large bodies of water, we find that very high volumes of liquid movement (at locations well above the mixer) are created by the "bubble plume".

An important refinement is the provision of a convex curved surface at the under/inner side of the annular ring plate 2. A sudden step at the junction of the ring plate 2 with the tube 1 would lead to flow separation at the corner and in effect a narrowing of the draft tube. For this reason a gradual curved transition is provided, to promote a smooth attached upward flow at the sides of the tube at its lower end. In the illustrated embodiment this is done economically by attaching downwardly convex segments 8 e.g. of plastics material on the flat under surfaces of the annular ring plate 2 in between the vanes 4. The skilled person will appreciate that this feature may also be provided by appropriate curved shaping of the ring plate 2; in turn this will require measures to make the top edges of the vanes 4 complementary.

Figure 3:
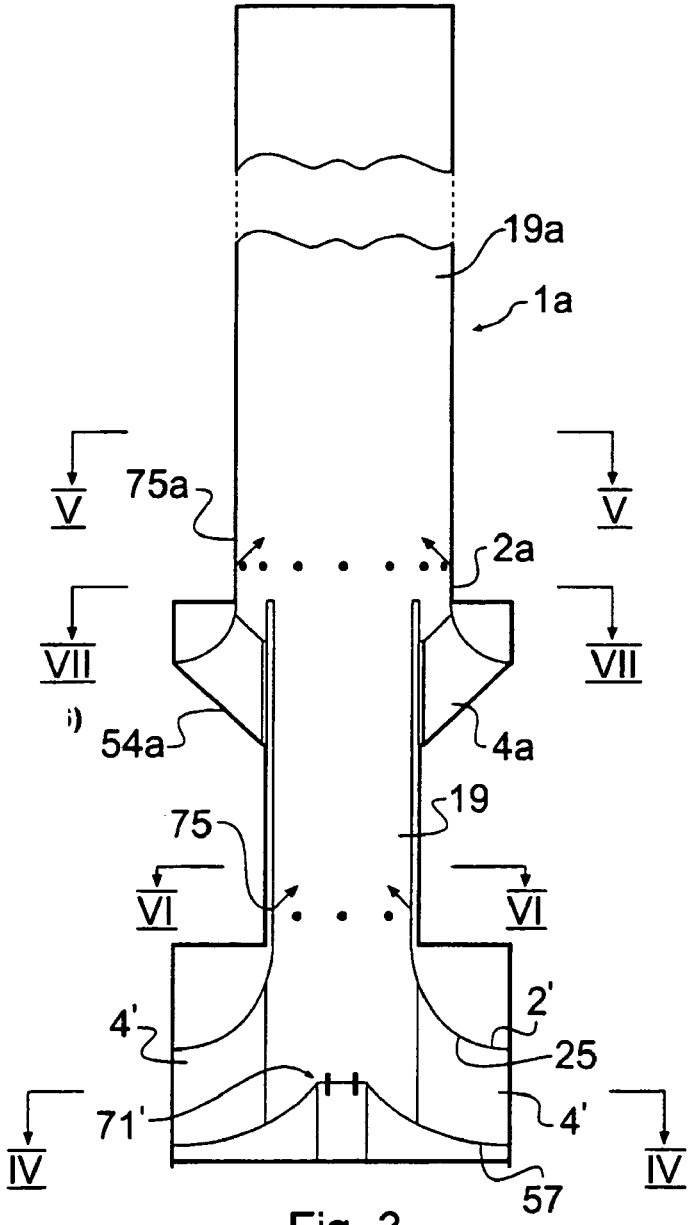
FIG. 3 is an axial section of a second embodiment having upper and lower draft tubes.

A second embodiment is shown in FIGS. 3 to 7. Distinctive features are as follows, starting at the foot of the device as seen in FIG. 3. The base 56 has an upward incline to a central eminence having the central air injection jets 71'. This improves flow direction at the bottom centre. The lower end of the draft tube 1' is formed integrally with an outwardly-flaring bell 2' forming a smooth curved transition surface 25 from the vertical tube wall to a horizontal top wall of the intake.

Figure 4:
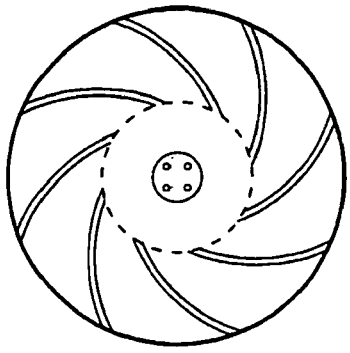
FIG. 4 is a cross-section at IV-IV of FIG. 3, showing a lower set of inlet vanes.
Figure 5:
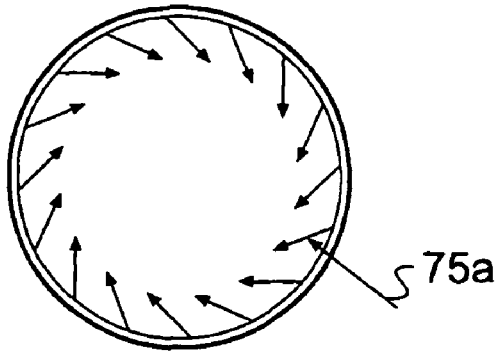
FIG. 5 and FIG. 6 show respectively the disposition of upper and lower sets of angled air jets in the second embodiment, at V-V and VI-VI of FIG. 3.
Figure 6:
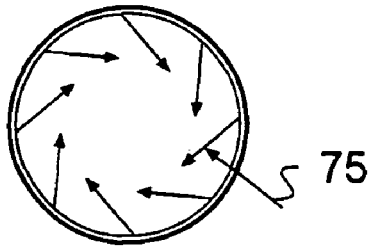
Figure 7:
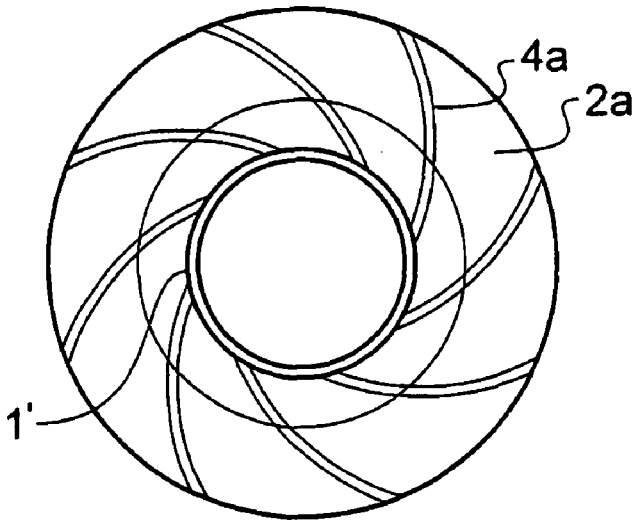
FIG. 7 shows the disposition of upper inlet vanes in the second embodiment as at VII-VII of FIG. 3.

The inlet vanes 4'—here eight in number—are correspondingly convex and concave at their lower and upper edges to complement the members above and below them. They are also curved in plan as seen in FIG. 4. In this embodiment, no supplementary air jets are provided in the region of the base and vanes. However these may advantageously be included. A set of air jets 75 is provided in the wall of the tube 1' near its lower end. These air jets are angled both upwardly and sideways to promote upward rotatory flow, although their primary effect is to create buoyant lift in the tube. They are supplied from an annular manifold, not shown.

The next and the most apparent difference is that this embodiment has a two-stage draft tube. An upper draft tube 1*a* of larger-diameter than the lower has its open lower end bell formation 2*a* overlapped above the open end of the lower tube 1'. An upper set of guide vanes 4*a* (see FIG. 7) connects between the two tubes. Supplementary interconnecting supports (not shown) may be provided to keep the tubes aligned. An upper set of air jets 75*a* is provided around the lower wall part of the upper draft tube 1*a*. See also FIG.

5, indicating that these jets also are angled upwardly and sideways relative to the radial direction.

We have found that this construction (which may double the tube lengths previously suggested) gives better scope for increasing the water flow at high air flow rates by comparison with the conventional Helixor device, which tends to choke i.e. reach a maximum water flow at an intermediate air flow rate which then scarcely increases with further increase in air flow.

Figure 8:
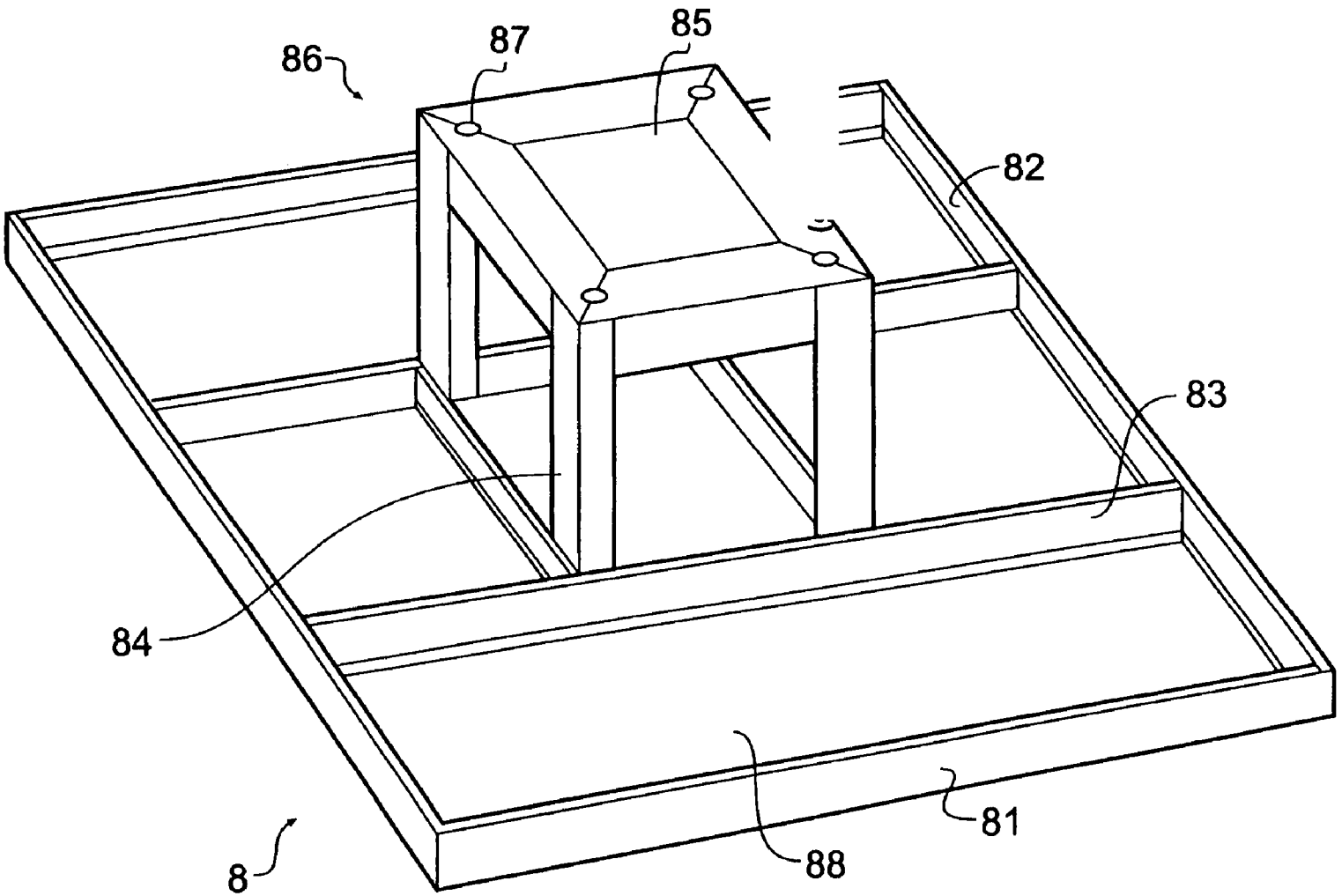
FIG. 8 shows a base support.

FIG. 8 shows an example of a support stand or base frame designed to support a mixer column as shown in FIGS. 1, 2 on the bed of a lake or reservoir. The base frame 8 consists of a flat bottom framework consisting of side and end frame members 81,82, with intermediate parallel frame members 83, on which a central pedestal or platform 86 is supported. The area of the base frame is much larger than the base area of the base plate 5 of the mixer. It may be for example at least five times larger. The spaces between the frame elements 81,82,83 are closed by panels 88 of a material suitable to prevent sinking into the bed material. These may be closed panels of metal or plastics material, or mesh panels. The frame elements may be constructed to allow ready interchange of such panels 88.

The central platform 86 has a height determined in view of the desired operating conditions. In particular, it is usually preferred that the intake to the mixer be above the bed so that solids are not needlessly disturbed. A typical height of the platform is from 0.3 to 1.5 m.

The top of the platform has frame members and preferably also a base plate 85, with corner bolt holes 87 for attachment to the corresponding bolt holes 51 of the column base plate 5. They can also be used for craning the support 8 into position.

Figure 10:
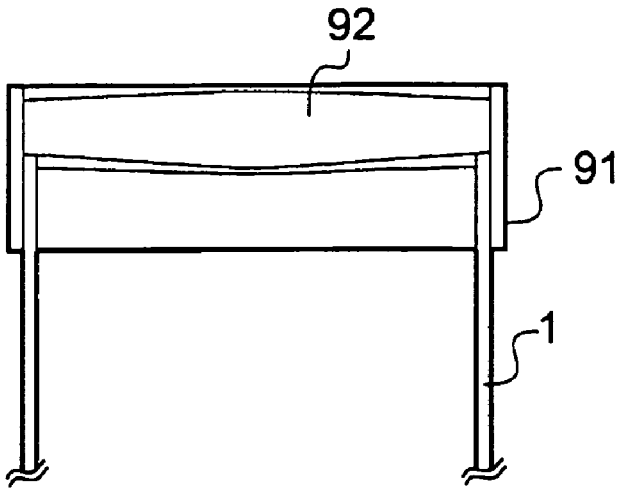
FIGS. 9 to 11 show a supplementary top vane assembly in plan, from the side fitted, and in section at XI-XI of FIG. 9.
Figure 9:
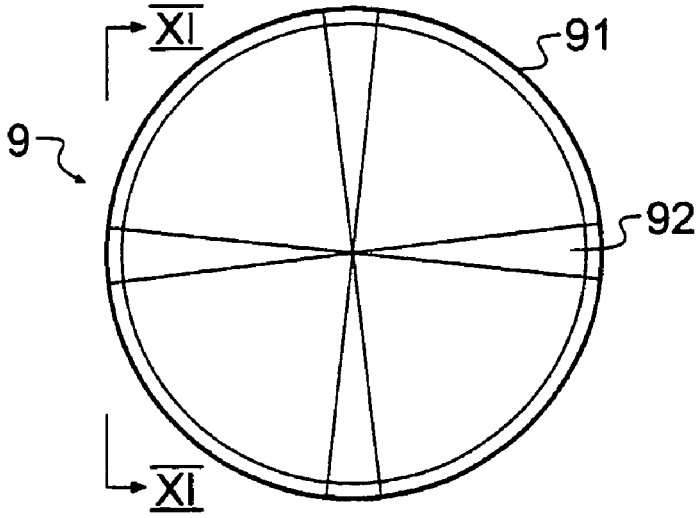
Figure 11:
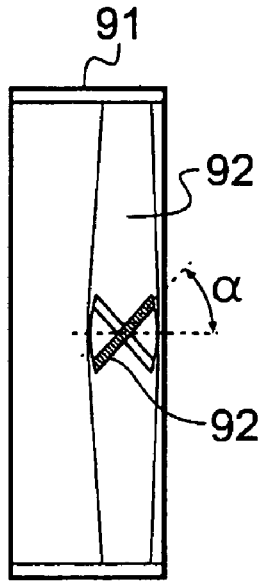

FIG. 9 shows an optional exit vane fitting 9, which can be attached onto the exit end 17 of the draft tube 1 to control or enhance swirl at that position. This may be desirable if there is a tendency for the swirl to become disordered in the otherwise empty draft tube 1. The illustrated example has an outer adaptor sleeve 91 with four radiating vanes 92 extending across it. The sleeve 91 fits onto the top of the draft tube 1 as shown in FIG. 10. The section in FIG. 11 shows the angling of the vanes 92, e.g. at angle $\alpha=30°$. Because these vanes 92 are of short axial extent (e.g. 100 mm; much shorter than the draft tube 1 overall) they cause little drag and occlude little of the plan flow area, as can be seen in FIG. 9. Alternatively, one or more fixed vane arrangements of this kind could be an integral part of the draft tube construction.

The invention claimed is:

1. A mixing apparatus comprising an elongate draft tube to be supported upright in a body of liquid, the draft tube having an upper exit end and a lower intake end, and a gas injector arrangement for injecting gas into liquid so that in use gasified liquid will rise buoyantly in the draft tube to issue from its exit end with rotational swirling of the liquid around the draft tube's axial direction, and drawing further liquid in at the intake end;

wherein the apparatus comprises an angled vane arrangement adjacent the intake end of the draft tube which comprises a set of vanes, angled from a radial direction and distributed around a circumferential liquid intake area at the intake end of the draft tube, and acts in use in concert with the intake flow caused by the gasification of the liquid to induce said rotational swirling of the liquid, the radial extent of said vanes lying at least partly outside the diameter of the draft tube, and the intake end of the draft tube connecting to an outward radial projection in the form of an outwardly-flaring wall portion beneath which said vanes are disposed, and wherein an axially-extending inner wall surface of the draft tube meets said outwardly-flaring wall portion via an outwardly-flaring transitional wall portion, gradually curved in axial cross-section, to promote smooth attached flow of indrawn liquid adjacent the draft tube wall at the intake end in use; the interior of the draft tube being open above the vane arrangement such that an open run of draft tube interior, unobstructed by traversing vanes, extends above the vane arrangement for at least 80% of the length of the draft tube.

2. A mixing apparatus according to claim 1 in which the open run of unobstructed draft tube interior above the vane arrangement extends at least 90% of the length of the draft tube, and preferably for the entire length thereof.

3. A mixing apparatus according to claim 1 having a base plate beneath the intake end of the draft tube, said outward radial projection of the intake end defining with the base plate a circumferentially-extending, radially-directed liquid intake area, the vanes extending between the radial projection and the base plate.

4. A mixing apparatus according to claim 3 in which the vanes are joined rigidly to both the radial projection and the base plate, and support the draft tube on the base plate.

5. A mixing apparatus according to claim 1, in which the vanes are flat and/or vertical.

6. A mixing apparatus according to claim 1 in which the vane arrangement projects radially beyond the main diameter of the draft tube.

7. A mixing apparatus according to claim 1, having an open region beneath the centre of the intake end of the draft tube, surrounded by the vane arrangement.

8. A mixing apparatus according to claim 1 in which the gas injector arrangement has an area array of jets distributed over the cross-sectional area of the draft tube adjacent its intake end.

9. An apparatus according to claim 1 in which the gas injector arrangement includes one or more central jets and/or jets distributed over the cross-section of the draft tube at a range of different radial and circumferential positions relative to the draft tube axis.

10. A mixing apparatus according to claim 8 in which a said array of gas injector jets is on or adjacent a base plate below the intake end of the draft tube.

11. A mixing apparatus according to claim 1 in which the gas injector arrangement has a side array of radially-inwardly directed jets.

12. A mixing apparatus according to claim 11 in which the side array of jets is in an annular arrangement.

13. A mixing apparatus according to claim 12 in which the annular arrangement of jets is at or below the intake end of the draft tube.

14. A mixing apparatus according to claim 12 in which the side array of jets includes jets distributed at different axial locations.

15. A mixing apparatus according to claim 1 in which the gas injector arrangement comprises a manifold for connection to a compressed gas supply, and having plural outward branches providing an array of plural gas injection jets.

16. A mixing apparatus according to claim 1 in which at least at the exit end of the draft tube a further draft tube of larger cross-sectional area is joined, with a further liquid intake adjacent the join for intake of further liquid to merge in use with liquid exiting the first draft tube.

17. A mixing apparatus according to claim 16 in which the further liquid intake has a further inclined vane arrangement for inducing rotational swirling of the further liquid entering the further draft tube.

18. A mixing apparatus according to claim 1 comprising a support base substantially larger in area than the base of the draft tube and vane arrangement, the support base providing a bottom portion for resting on the bed or floor of a body of liquid and a raised pedestal on which the draft tube with its angled vane arrangement is mounted.

19. A method of causing mixing in a body of liquid, by providing mixing apparatus according to claim 1 in said body of liquid and supplying gas under pressure to the gas injector arrangement thereof, gasifying liquid at the draft tube thereby causing the gasified liquid to rise buoyantly up the tube and out of its exit end, at the same time drawing liquid in at the intake end over the angled vane arrangement to impose a swirling flow on the liquid rising up the draft tube.

20. A method according to claim 19 in which the body of liquid is a lake, pond, sea or reservoir.

21. A method according to claim 19 in which the body of liquid being treated is of liquid waste.

22. A method according to claim 19 in which the gas is an oxygen-containing gas such as oxygen, air or oxygen-enriched air.

23. A method according to claim 19 in which the mixing apparatus is supported on a bed or floor of the body of water, or is suspended in the body of water.

* * * * *